United States Patent [19]

Hokama

[11] 4,366,828

[45] Jan. 4, 1983

[54] MANICURE APPARATUS FOR SMOOTHING AND BUFFING NAILS

[75] Inventor: Yosh Hokama, Torrance, Calif.

[73] Assignee: Makaja Inc., Gardena, Calif.

[21] Appl. No.: 250,572

[22] Filed: Apr. 3, 1981

[51] Int. Cl.[3] ..... A45D 29/04
[52] U.S. Cl. ..... 132/75.6
[58] Field of Search ..... 132/75.6, 76.4

[56] References Cited

U.S. PATENT DOCUMENTS

| | | | |
|---|---|---|---|
| 1,473,933 | 11/1923 | Green | 132/76.5 |
| 1,604,685 | 10/1926 | Everitt | 132/75.6 |
| 2,091,807 | 8/1937 | Crum | 132/75.6 |
| 4,184,499 | 1/1980 | Seidler | 132/75.6 |
| 4,211,246 | 7/1980 | Hokama | 132/76.4 |

*Primary Examiner*—G. E. McNeill
*Attorney, Agent, or Firm*—William W. Haefliger

[57] ABSTRACT

Apparatus is provided to smooth, buff and shine fingernails, and the apparatus is invertible by finger flexing.

9 Claims, 7 Drawing Figures

MANICURE APPARATUS FOR SMOOTHING AND BUFFING NAILS

BACKGROUND OF THE INVENTION

This invention relates generally to apparatus used by manicurists to smooth and buff fingernails. More specifically it concerns a unitary device capable of convenient use to carry out both of these functions, or similar functions.

At the present time and in the past, manicurists accomplished smoothing and buffing of fingernails by using two different devices. It was therefore necessary to repeatedly lay one device down, pick up the other device and adjust the hand or fingers to it in order to accurately smooth and then buff fingernails, whereby time and effort were wasted. Such wastage is seen to be enhanced by virtue of the fact that the manicurist might switch between these tools several times in processing each fingernail.

U.S. Pat. No. 4,211,246 discloses a device which reduces the above problems; however, its accommodation to different hand size at times presents some difficulty.

SUMMARY OF THE INVENTION

It is a major object of the invention to provide apparatus overcoming the time wastage problems referred to above, and also characterized as automatically adjusting the manicurists hand to a device capable of both functions, i.e. both smoothing and buffing of fingernails, for example.

The present apparatus fundamentally comprises (a) means including a frame and resiliently compressible structure on the frame for defining a generally longitudinally extending zone to snugly receive a user's fingers, and characterized in that compression is then exerted by such structure on the user's fingers and said means is carried by such fingers for reciprocation, and (b) fingernail processing means carried on the frame and extending generally longitudinally to be reciprocated in engagement with a nail being processed, as the user's fingers and the frame are reciprocated generally longitudinally.

As will appear, the resiliently compressible structure may consist of resilient synthetic resinous foam, or an elastomer; it is typically lengthwise elongated at opposite sides of the finger zone which may define an elongated slit; and the frame in the form of a shell may define opposite side windows at which the foam and slit are presented for ease of finger insertion and retention by the foam, the fingers also extending through the windows, and the shell retaining the foam positioned for finger retention.

Further, the nail processing means may include first and second nail smoothing strips, of different (fine and coarse) abrasive qualities, and elongated cushions mounting the strips to the frame at a lower outer portion of the frame; and the frame may carry a nail buffing strip mounted on a cushion attached to an upper and outer elongated portion of the frame. Either of the first two strips may be employed in smoothing a fingernail as the device is reciprocated longitudinally. Due to the construction, the assembly, with fingers inserted through the slit, may be inverted in response to finger flexing to present the buffing strip downwardly, for endwise reciprocation in buffing contact with a fingernail. Cushioning of the strips facilitates such smoothing and buffing as well as gripping of the device in inverted position as described.

These and other objects and advantages of the invention, as well as the details of an illustrative embodiment, will be more fully understood from the following description and drawings, in which:

DRAWING DESCRIPTION

FIG. 1 is a front side elevation view of the device, the rear side appearing the same;

FIGS. 2 and 3 are fragmentary sections on lines 2—2 and 3—3 of FIG. 1;

DETAILED DESCRIPTION

Figure 2:
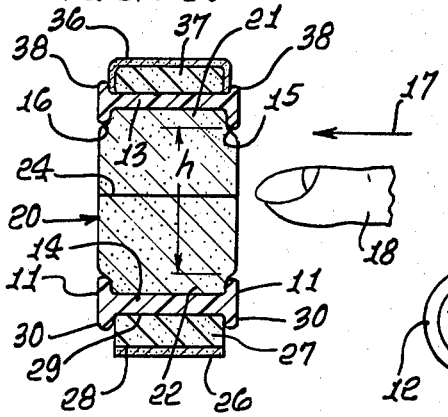
Figure 3:
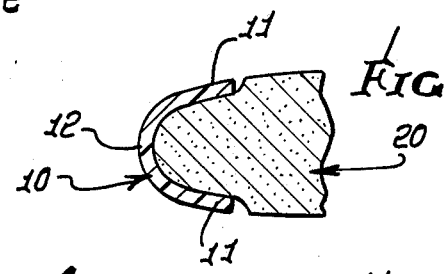
Figure 4:
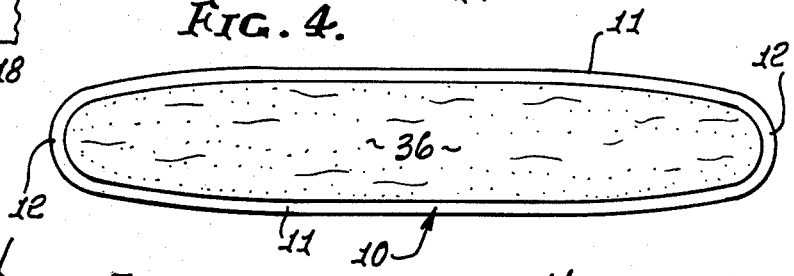
FIGS. 4 and 5 are top and bottom plan views, respectively of the FIG. 1 device.
Figure 5:
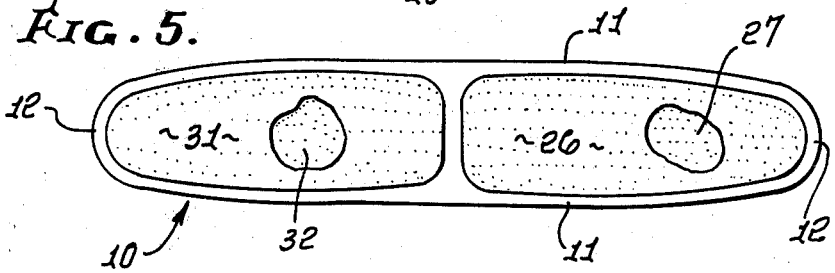

The invention comprises means including a frame and resiliently compressible structure on the frame for defining a generally longitudinally extending zone to snugly receive a user's fingers, and characterized in that compression is then exerted by such structure on the user's fingers and said means is carried by such fingers for reciprocation. In the example, a molded plastic (i.e. synthetic resin) frame 10 has the form of a longitudinally elongated shell, with side walls 11, curved end walls 12, and top and bottom walls 13 and 14. The side walls 11 define longitudinally elongated windows 15 and 16 which are opposite one another, to allow user's finger 18 entry or passage completely through the shell in widthwise direction (indicated by arrow 17 in FIG. 2). The windows typically extend lengthwise, with oval configuration, and throughout the major length of the shell to freely receive all four fingers of the user's hand (see FIG. 6). The height of the window (see dimension "h") is typically at least about $\frac{5}{8}$ inch, typically between $\frac{5}{8}$ and $1\frac{1}{2}$ inches.

The above referred to resiliently compressible structure may take the form of plastic foam body (polyurethane for example) indicated generally at 20. In the example, the body 20 has upper and lower elongated surfaces 21 and 22 located between opposite shell walls 11, and the body is typically bonded to the shell inner surface, as for example inner surfaces of walls 11 and/or the inner surfaces of walls 13 and 14, whereby the foam body is received or anchored in position, and in slight compression.

The foam body further defines a generally elongated zone, such as through slit or slot 24 located about midway between the upper and lower edges of the windows 15 and 16, for presentation to finger insertion. The slot or zone is longitudinally elongated sufficiently to accept penetration of the user's four fingers indicated by broken lines **18*a*–18*d*, in FIG. 1. The deformed slot and its upper and lower edges then compressively and resiliently engage and conform to curvature of the upper and lower surfaces of the fingers, such edges indicated at 24*a* and 24*b*. The compressive engagement of the foam body 20 with the fingers is then sufficiently sturdy as to enable longitudinal reciprocation of the device by fingers 18*a*–18*d*** in active processing engagement with a fingernail or multiple fingernails, as will be described.

Figure 6:
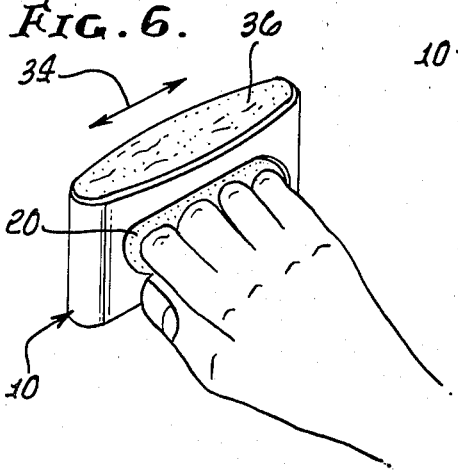
FIG. 6 is a perspective showing the device with fingers inserted through the retention foam and windows, for smoothing a fingernail.
Figure 7:
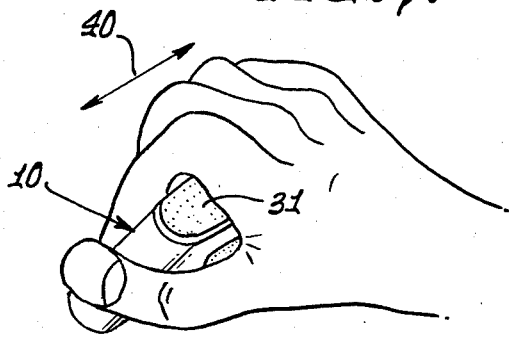
FIG. 7 is a perspective showing of the device in inverted position, with fingers flexed, and positioned for buffing a fingernail.

(See also FIGS. 6 and 7). When the fingers are withdrawn from the slot or slit, the latter restores toward FIG. 1 position at 24.

A further aspect of the invention includes the provision of fingernail processing means carried on the frame and extending generally longitudinally to be reciprocated in engagement with a nail being processed, as the user's fingers and the frame are reciprocated generally longitudinally. In the example, the nail processing means includes a first nail smoothing strip, such as flexible strip 26, carried by an elongated cushion or pad 27, which is in turn carried by the frame. Adhesive may bond the strip 26 to the foam plastic cushion 27 at 28, and adhesive may bond the cushion to the inwardly recessed lower wall 14 of the frame, at 29. Note frame flanges 30 between which the cushion is protectively received against dislodgement, the strip 26 spaced outwardly of such flanges. In similar manner, a second nail smoothing strip, such as flexible strip 31, is carried by an elongated cushion or pad 32, which is in turn carried by the frame. The strip 32 is connected to cushion 32, and the latter bonded to frame lower wall 14. Grit or abrasive sizes on the outer surface of strips 26 and 31 may differ, so that, for example, strip 26 is "coarse" and strip 31 is "fine", whereby the user may quickly shift the device to the left or right to vary the processing of a fingernail as by left to right reciprocation (see arrow 34 in FIG. 6). Note that each strip 26 and 31 extends only partially (for example less than half) along the length of the frame lower wall. Pads 27 and 32 are typically sponge-like.

The nail processing means may also advantageously include a nail buffing strip, such as chamois layer 36 on or covering the resilient foam plastic cushion or pad 37 which mounts the layer 36 to the upper and inwardly recessed wall 13 of the frame. Thus the frame flanges 38 protectively retain the cover 36 and the pad 37 therebetween, and against dislodgement. The buffing cover may be bonded to the pad, and the pad bonded to wall 13.

Buffing strip or cover 36 extends lengthwise throughout the major length of the frame, and is adapted to be reciprocated in the direction of arrows 40 in FIG. 7. Note in FIG. 7 that the user's fingers have been flexed to invert the device, so that strip 36 is there presented downwardly to engage the nail 42. Thus the user's fingers need only be flexed or unflexed to selectively shift the device between selected smoothing, and buffing positions.

Figure 1:
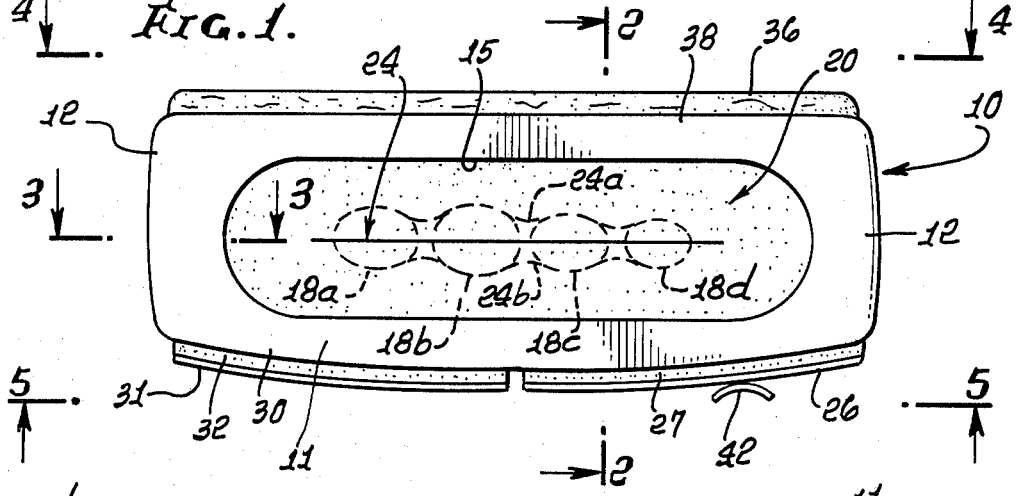

In FIG. 1, the length of slot 24 is typically between about 3 inches and $4\frac{1}{2}$ inches.

The grit on layer 26 is typically about #1,200.

As is clear the applicator smooths, buffs and shines nails.

I claim:

1. In manicure nail processing apparatus, (a) a frame and resiliently compressible foam structure on the frame for defining a generally longitudinally extending zone in the form of a through slit everywhere spaced from the frame to snugly receive a user's fingers, and characterized in that compression is then exerted by such foam structure on opposite sides of the user's fingers, and said frame is then carried by such fingers via said foam structure for reciprocation, the frame defining laterally spaced windows which are longitudinally elongated, the foam structure and said slit exposed at said windows, and (b) fingernail processing means carried on the frame and extending generally longitudinally to be reciprocated in engagement with a nail being processed, as the user's fingers and the frame are reciprocated generally longitudinally.

2. The apparatus of claim 1 wherein the frame is in the form of a shell receiving said resiliently compressible structure.

3. The apparatus of claim 1 wherein said nail processing means includes a first nail smoothing strip, and including a cushion on the frame and carrying said strip.

4. The apparatus of claim 2 wherein the shell has upper longitudinal extent and lower longitudinal extent, with said resiliently compressible structure located therebetween.

5. The apparatus of claim 3 wherein said nail processing means includes a second nail smoothing strip, and including a cushion on the frame carrying said second strip.

6. The apparatus of claim 3 wherein said nail processing means includes a nail buffing strip, and including a cushion on the frame and carrying said buffing strip.

7. The apparatus of claim 4 wherein said nail processing means includes a first nail smoothing strip, and including a cushion on said frame upper longitudinal extent and carrying said strip.

8. The apparatus of claim 7 wherein said nail processing means includes a second nail smoothing strip, and including a cushion on said frame upper longitudinal extent and carrying said second strip.

9. The apparatus of claim 7 wherein said nail processing means includes a nail buffing strip, and including a cushion on said frame lower longitudinal extent, and carrying said buffing strip.

* * * * *